US008833439B2

(12) United States Patent
Zimmerman et al.

(10) Patent No.: US 8,833,439 B2
(45) Date of Patent: Sep. 16, 2014

(54) GALVANICALLY ISOLATED EXIT JOINT FOR WELL JUNCTION

(75) Inventors: Michael Paul Zimmerman, Claremont (AU); David Joe Steele, Arlington, TX (US); Pao-Shih Chen, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 448 days.

(21) Appl. No.: 13/091,791

(22) Filed: Apr. 21, 2011

(65) Prior Publication Data

US 2012/0267093 A1 Oct. 25, 2012

(51) Int. Cl.
*E21B 43/11* (2006.01)
*E21B 41/00* (2006.01)

(52) U.S. Cl.
CPC ..... *E21B 41/0042* (2013.01)
USPC ..... 166/55; 166/297; 166/113

(58) Field of Classification Search
CPC ..... E21B 29/06; E21B 7/061; E21B 29/00; E21B 29/002; E21B 17/06; E21B 17/00; E21B 17/02; E21B 17/08
See application file for complete search history.

(56) References Cited

U.S. PATENT DOCUMENTS 1,762,766 A * 6/1930 De Garay ..... 285/331
5,615,740 A 4/1997 Comeau et al.
6,116,337 A 9/2000 Civarolo et al.
6,158,513 A 12/2000 Nistor et al.
6,422,316 B1 * 7/2002 Schutz et al. ..... 166/367
6,868,909 B2 * 3/2005 Murray ..... 166/298
6,913,082 B2 7/2005 McGlothen et al.
7,404,444 B2 * 7/2008 Costa et al. ..... 166/380
2009/0288817 A1 * 11/2009 Parlin et al. ..... 166/50

OTHER PUBLICATIONS

Gelfgat, Mikhail Ya., Aluminium Alloy Tubulars—Assessment for Ultralong Well Construction, Nov. 11-14, 2007, SPE 109722, Society of Petroleum Engineers.
International Search Report and Written Opinion, PCT/US2010/032029, KIPO, Oct. 25, 2012.

* cited by examiner

*Primary Examiner* — Jennifer H Gay
*Assistant Examiner* — Caroline Butcher
(74) *Attorney, Agent, or Firm* — Lawrence R. Youst

(57) ABSTRACT

A well system for forming a window in a casing string positioned in a wellbore. The system includes first and second steel casing joints (462, 464) interconnectable within the casing string. An aluminum exit joint (460) is positioned between the first and second steel casing joints (462, 464). The aluminum exit joint (460) has a first interconnection with the first steel casing joint (462) and a second interconnection with the second steel casing joint (464). The aluminum exit joint (460) is operable to have the window formed therethrough. A first sleeve (470) is positioned within the first interconnection to provide galvanic isolation between the aluminum exit joint (460) and the first steel casing joint (462). A second sleeve (472) is positioned within the second interconnection to provide galvanic isolation between the aluminum exit joint (460) and the second steel casing joint (464).

12 Claims, 12 Drawing Sheets

28
10
26
12
20
18
30
22
16
24
30
32
34
36
42
40
44
38
14

408
406
400
402
404
410
414
412
416
418

GALVANICALLY ISOLATED EXIT JOINT FOR WELL JUNCTION

TECHNICAL FIELD OF THE INVENTION

This invention relates, in general, to equipment utilized in conjunction with operations performed in subterranean wells and, in particular, to a galvanically isolated exit joint for a well junction.

BACKGROUND OF THE INVENTION

Without limiting the scope of the present invention, its background will be described in relation to forming a window in a casing string for a multilateral well, as an example.

In multilateral wells it is common practice to drill a branch or lateral wellbore extending laterally from an intersection with a main or parent wellbore. Typically, once the casing string is installed in the parent wellbore, a whipstock is positioned in the casing string at the desired intersection and then one or more mills are deflected laterally off of the whipstock to form a window through the casing sidewall.

In certain installations, it is desirable to drill the lateral wellbore out of the high side of the parent wellbore. In such installations, it is necessary to form the window in the high side of the parent casing. One proposed solution is to pre-mill the window in the casing, that is, form the window through the casing sidewall prior to installing the casing in the parent wellbore. The casing is then installed in the wellbore and rotated such that the window is in the desired location and orientation.

It has been found, however, that if the casing is to be cemented in the main wellbore, the window must be closed during the cementing operation, such as by using an internal or external sleeve. Typically, the sleeve is made of an easily milled material or is made so that it can be retrieved after the cementing operation. Although such sleeves have achieved some success, they have problems. For example, the sleeve material may be incompatible with fluids used in the well. The use of an external sleeve increases the casing outer diameter, requiring either a smaller casing size to be used, or a larger wellbore to be drilled. The use of an internal sleeve reduces the casing inner diameter, restricting the passage of fluids and equipment through the casing. The use of a shiftable or retrievable inner sleeve requires another operation in the well and increases the complexity of the equipment and the procedure.

In addition, it has been found, that circumferentially orienting a casing string with a pre-milled window is difficult. Specifically, due to the large diameter, long length, high string weight and the friction between the casing string and the borehole, high torque is required to rotate the casing string. Such rotation of the casing string can cause damage to the casing string or the pre-milled window and may lack the precision necessary to properly orient the pre-milled window to the high side.

Accordingly, a need has arisen for improved systems and methods of constructing a multilateral well that include one or more branch wellbores extending from a main wellbore. In addition, a need has arisen for such improved systems and methods that do not require forming the window through the casing sidewall prior to installing the casing in the parent wellbore. Further, a need has arisen for such improved systems and methods that do not require circumferential orientation of the casing string once it has been run in the parent wellbore.

SUMMARY OF THE INVENTION

The present invention disclosed herein is directed to improved systems and methods of constructing a multilateral well that include one or more branch wellbores extending from a main wellbore. The improved systems and methods of the present invention do not require forming the window through the casing sidewall prior to installing the casing string in the parent wellbore. In addition, the improved systems and methods of the present invention do not require circumferential orientation of the casing string once it has been run in the parent wellbore.

In one aspect, the present invention is directed to a well system for forming a window in a casing string positioned in a wellbore. The system includes first and second steel casing joints that are interconnectable within the casing string. An aluminum exit joint is positioned between the first and second steel casing joints. The aluminum exit joint has a first interconnection with the first steel casing joint and a second interconnection with the second steel casing joint. The aluminum exit joint is operable to have the window formed therethrough. A first sleeve is positioned within the first interconnection providing galvanic isolation between the aluminum exit joint and the first steel casing joint. A second sleeve is positioned within the second interconnection providing galvanic isolation between the aluminum exit joint and the second steel casing joint.

In one embodiment, the first and second interconnections are threaded interconnections. In this embodiment, a first nonconductive layer may be positioned within the first interconnection preventing metal-to-metal contact between the aluminum exit joint and the first steel casing joint and a second nonconductive layer may be positioned within the second interconnection preventing metal-to-metal contact between the aluminum exit joint and the second steel casing joint.

In certain embodiments, the first and second sleeves are formed from a nonconductive material such as a polymer including PEEK polymers and plastics, a fiberglass such as S-glass fiberglass with a nonconductive matrix or the like. In some embodiments, the first and second sleeves may include a wear resistant material such as tungsten or ceramics beads.

In another aspect, the present invention is directed to a well system for forming a window in a casing string positioned in a wellbore. The system includes first and second steel casing joints that are interconnectable within the casing string. An aluminum exit joint is positioned between the first and second steel casing joints. The aluminum exit joint has a first interconnection with the first steel casing joint and a second interconnection with the second steel casing joint. The aluminum exit joint is operable to have the window formed therethrough. A sleeve is positioned within the aluminum exit joint and extends into at least a portion of the first steel casing joint and at least a portion of the second steel casing joint to provide galvanic isolation between the aluminum exit joint and the first and second steel casing joints.

In a further aspect, the present invention is directed to a well system for forming a window in a casing string positioned in a wellbore. The system includes first and second steel casing joints that are interconnectable within the casing string. An aluminum exit joint is positioned between the first and second steel casing joints. The aluminum exit joint has a first interconnection with the first steel casing joint and a second interconnection with the second steel casing joint. The aluminum exit joint is operable to have the window formed therethrough. A first internal sleeve is positioned within the first interconnection. A second internal sleeve is positioned within the second interconnection. A first outer sleeve is positioned around the first interconnection. A second outer sleeve is positioned around the second interconnection. The first inner and outer sleeves provide galvanic isolation between the aluminum exit joint and the first steel casing joint. The second inner and outer sleeves provide galvanic isolation between the aluminum exit joint and the second steel casing joint.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
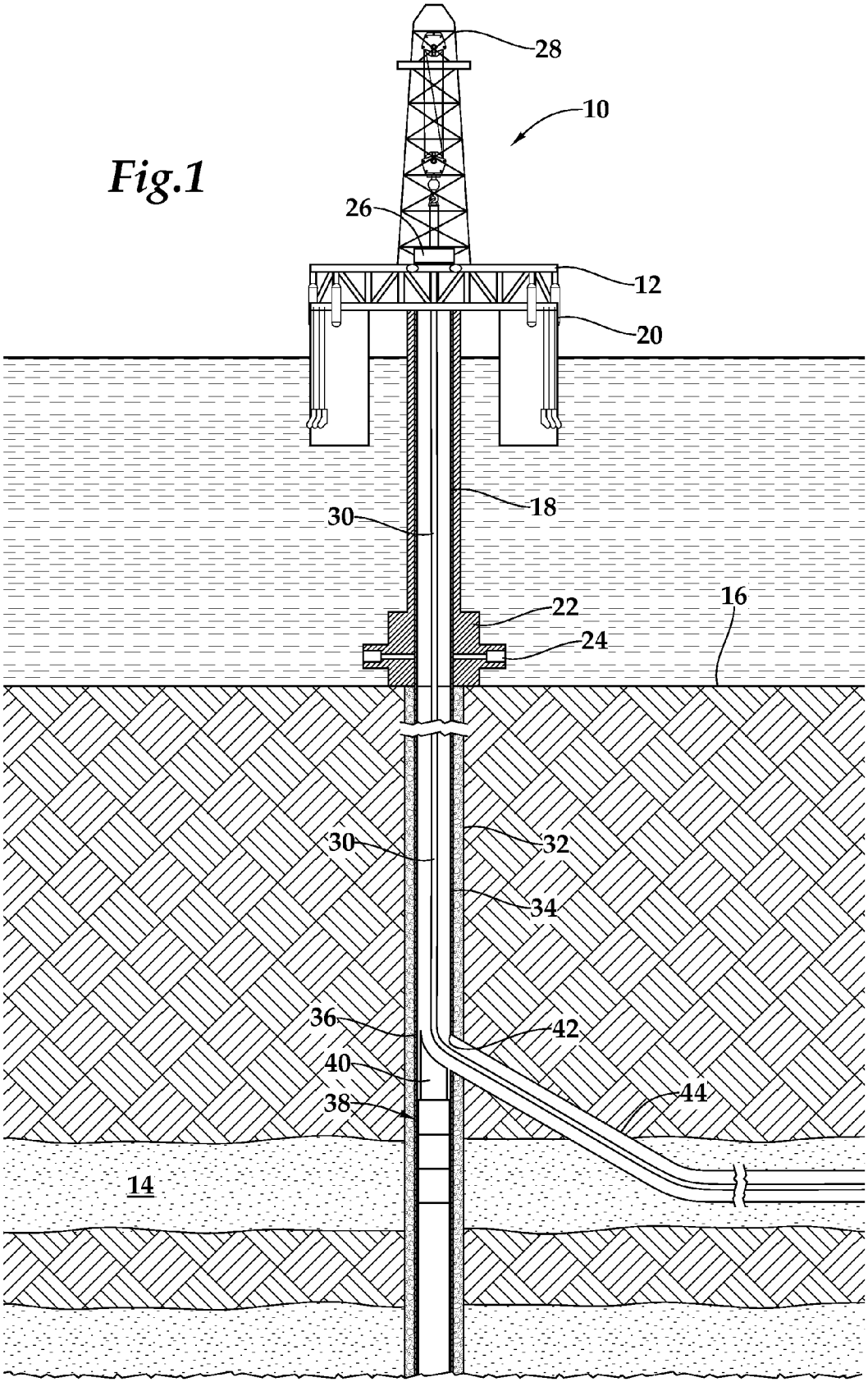
FIG. 1 is a schematic illustration of an offshore platform utilizing a galvanically isolated exit joint for a multilateral well according to an embodiment of the present invention.

Referring to FIG. 1, a galvanically isolated exit joint for a multilateral well in use with an offshore oil and gas platform is schematically illustrated and generally designated 10. A semi-submersible platform 12 is centered over submerged oil and gas formation 14 located below sea floor 16. A subsea conduit 18 extends from deck of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The casing string 34 includes a galvanically isolated aluminum exit joint 36, as explained in greater detail below, interconnected therein. In addition, casing string 34 includes an alignment subassembly 38 having a whipstock assembly 40 positioned therein. Whipstock assembly 40 has a deflector surface that is positioned in a desired circumferential orientation relative to exit joint such that a window 42 can be milled, drilled or otherwise formed in exit joint 36 in the desired circumferential direction. As illustrated, exit joint 36 is positioned at a desired intersection between main wellbore 32 and a branch or lateral wellbore 44. The terms "branch" and "lateral" wellbore are used herein to designate a wellbore which is drilled outwardly from its intersection with another wellbore, such as a parent or main wellbore. A branch or lateral wellbore may have another branch or lateral wellbore drilled outwardly therefrom.

Even though FIG. 1 depicts a vertical section of the main wellbore, it should be understood by those skilled in the art that the present invention is equally well suited for use in wellbores having other directional configurations including horizontal wellbores, deviated wellbores, slanted wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
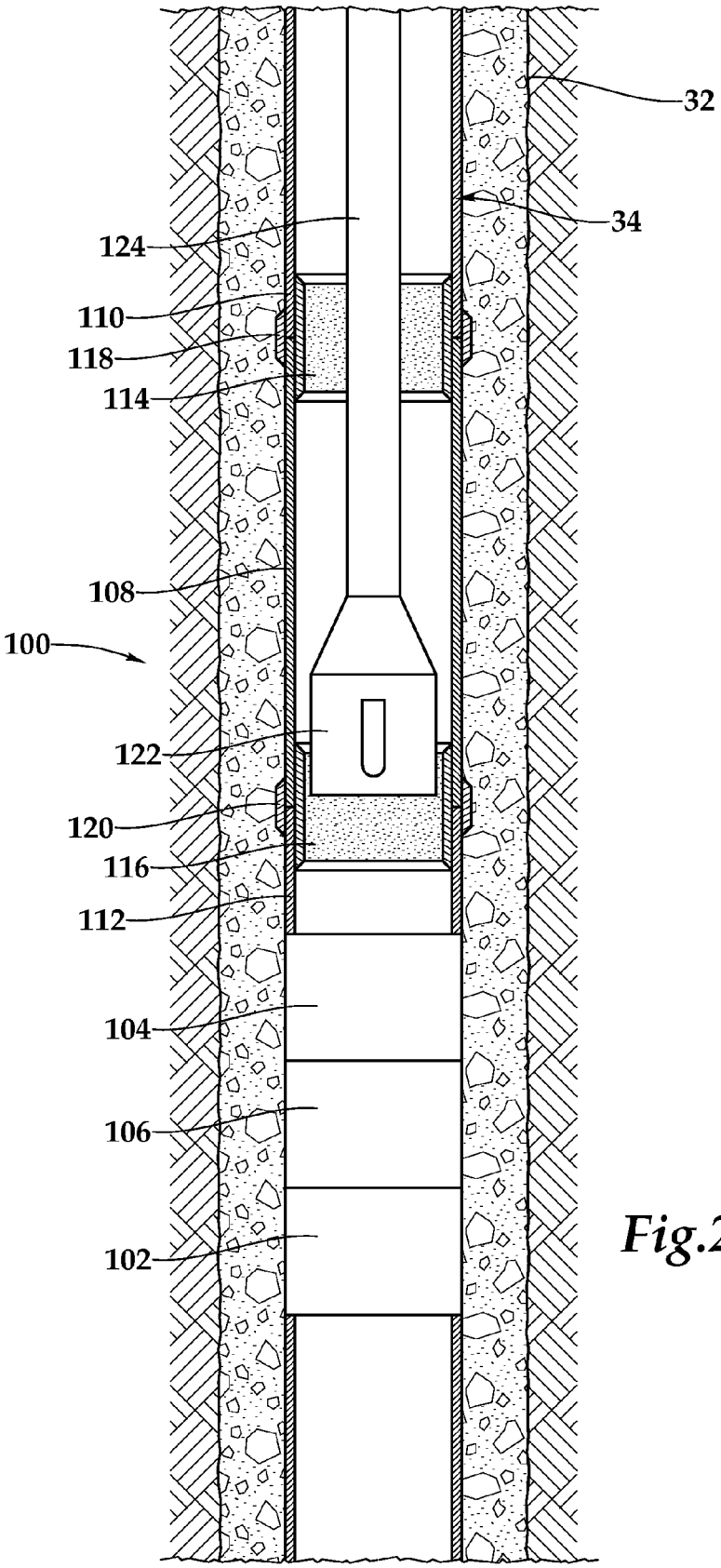
FIG. 2 is a schematic illustration of a galvanically isolated exit joint for a multilateral well during an alignment operation according to an embodiment of the present invention.

Referring now to FIG. 2, a well system including an exit joint and portions of a downhole alignment system is schematically depicted and generally designated 100. In the illustrated embodiment, well system 100 includes a plurality of tools and tubular interconnected to form casing string 34. Casing string 34 includes a latch coupling 102 that preferably has a profile and a plurality of preferential circumferential alignment elements operable to receive a latch assembly therein and locate the latch assembly in a particular circumferential orientation. Casing string 34 also includes an alignment bushing 104 that preferably has a longitudinal slot that is circumferentially referenced to the preferential circumferential alignment elements of latch coupling 102.

Positioned between latch coupling 102 and alignment bushing 104 is a casing alignment sub 106 that is used to ensure proper alignment of latch coupling 102 relative to alignment bushing 104. Together, latch coupling 102, alignment bushing 104 and casing alignment sub 106 may be referred to as an alignment subassembly, such as alignment subassembly 38 referred to above with reference to FIG. 1. It should be noted, however, that even though FIG. 2 depicts the alignment subassembly of the present invention as including latch coupling 102, alignment bushing 104 and casing alignment sub 106, it should be understood by those skilled in the art that the alignment subassembly of the present invention may include a greater or lesser number of tools or a different set of tools that are operable to enable a determination of an offset angle between a circumferential reference element and a desired circumferential orientation of the window and engage with an alignment element of a whipstock assembly to position the deflector surface of the whipstock assembly in a desired circumferential orientation relative to the exit joint. Also, even though the components of the alignment subassembly of the present invention has been described as being interconnected within casing string 34, it should be noted by those skilled in the art that certain components of the alignment subassembly or the entire alignment subassembly could alternatively be run in casing string 34 after casing string 34 is installed.

In the illustrated embodiment, casing string 34 includes a galvanically isolated aluminum exit joint 108 that is preferably formed for easy milling or drilling therethrough. As illustrated, exit joint 108 is coupled to standard casing joints 110, 112 that are typically formed from steel such as low alloy steel. As metal-to-metal contact between dissimilar metals in a conductive solution may result in galvanic corrosion, including hydrogen embrittlement of the steel casing joints, exit joint 108 is galvanically isolated from casing joints 110, 112 according to the present invention. In the illustrated embodiment, an internal sleeve 114 and external sleeve 118 provide isolation between exit joint 108 and casing joint 110. Likewise, an internal sleeve 116 and external sleeve 120 provide isolation between exit joint 108 and casing joint 112. Internal sleeves 114, 116 and external sleeves 118, 120 are preferably formed from a nonconductive material such as a polymer including PEEK polymers and plastics, a fiberglass such as S-glass fiberglass or other material suitable for reducing or preventing the flow a galvanic current between exit joint 108 and casing joints 110, 112.

Also illustrated in FIG. 2, downhole a survey or alignment tool 122 has been run into casing string 34 on a conveyance 124 such as jointed tubing, coiled tubing, electric line, wireline or the like after casing string 34 is installed or with casing string 34 while it is being installed. Survey tool 122 is used for determining the circumferential alignment of a circumferential reference element within the alignment subassembly such as the longitudinal slot of alignment bushing 104, the preferential circumferential alignment elements of latch coupling 102 or other identifiable reference.

Figure 3:
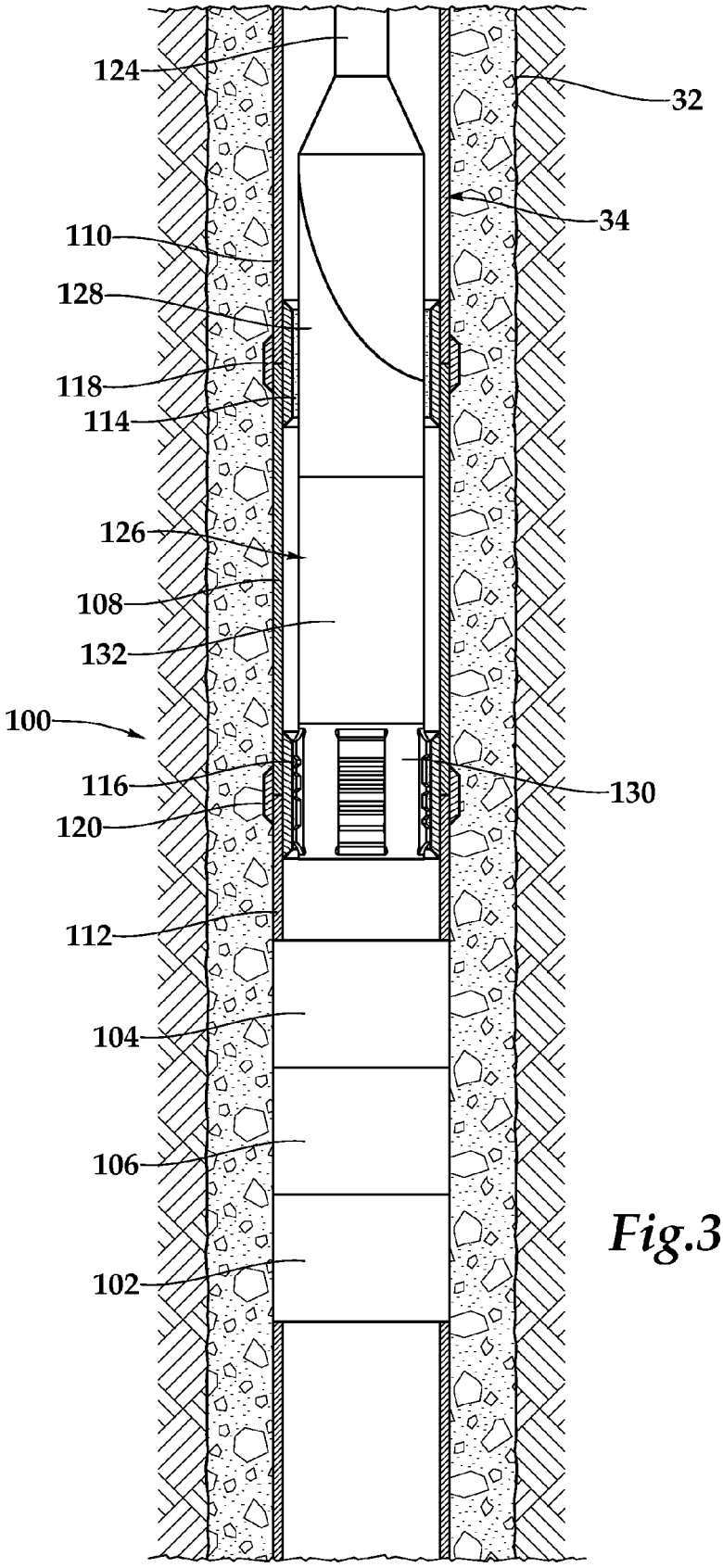
FIG. 3 is a schematic illustration of a galvanically isolated exit joint for a multilateral well during a whipstock installation operation according to an embodiment of the present invention.

Referring now to FIG. 3, additional portions of the downhole alignment system operating with an exit joint for forming a window for a multilateral well of the present invention are schematically illustrated. In the illustrated embodiment, the alignment subassembly includes latch coupling 102, alignment bushing 104 and casing alignment sub 106 as described above. In addition, the downhole alignment system includes whipstock assembly 126 that has been run into casing string 34 on conveyance 124 after survey tool 122 is run and after whipstock assembly 126 is configured as described below. As illustrated, whipstock assembly 126 includes a deflector assembly 128 having a deflector surface operable to direct a milling or drilling tool into the sidewall of exit joint 108 to create a window therethrough. Whipstock assembly 126 also includes a latch assembly 130 having an outer profile that is operable to engage with the inner profile and preferential circumferential alignment elements of latch coupling 102.

Figure 4:
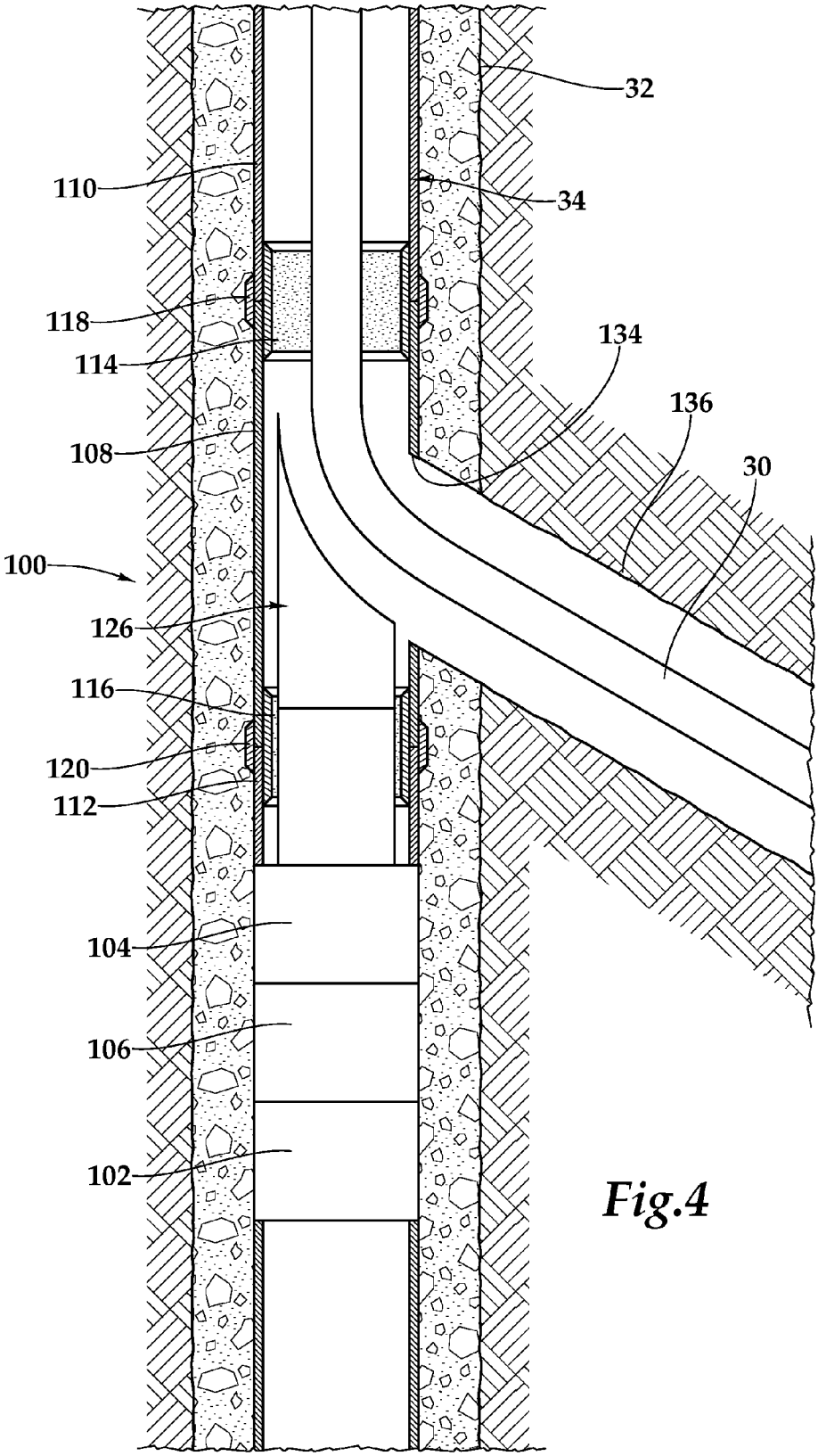
FIG. 4 is a schematic illustration of a galvanically isolated exit joint for a multilateral well during a lateral well drilling operation according to an embodiment of the present invention.

In addition, whipstock assembly 126 has a swivel subassembly 132 that is rotatably positioned between deflector assembly 128 and latch assembly 130 and is operable to selectively allow and prevent relative rotation between deflector assembly 128 and latch assembly 130. Swivel subassembly 132 enables whipstock assembly 126 to be configured in response to the offset angle determined by survey tool 122 by rotating deflector assembly 128 relative to latch assembly 130 such that the deflector surface will be oriented in a desired circumferential orientation relative to exit joint 108 following engagement of latch assembly 130 with latch coupling 102, as best see in FIG. 4. As illustrated, whipstock assembly 124 has engaged the alignment subassembly such that the deflector surface is oriented to the direct the milling or drilling tool in the desired orientation to form window 134 and branch wellbore 136.

Figure 5:
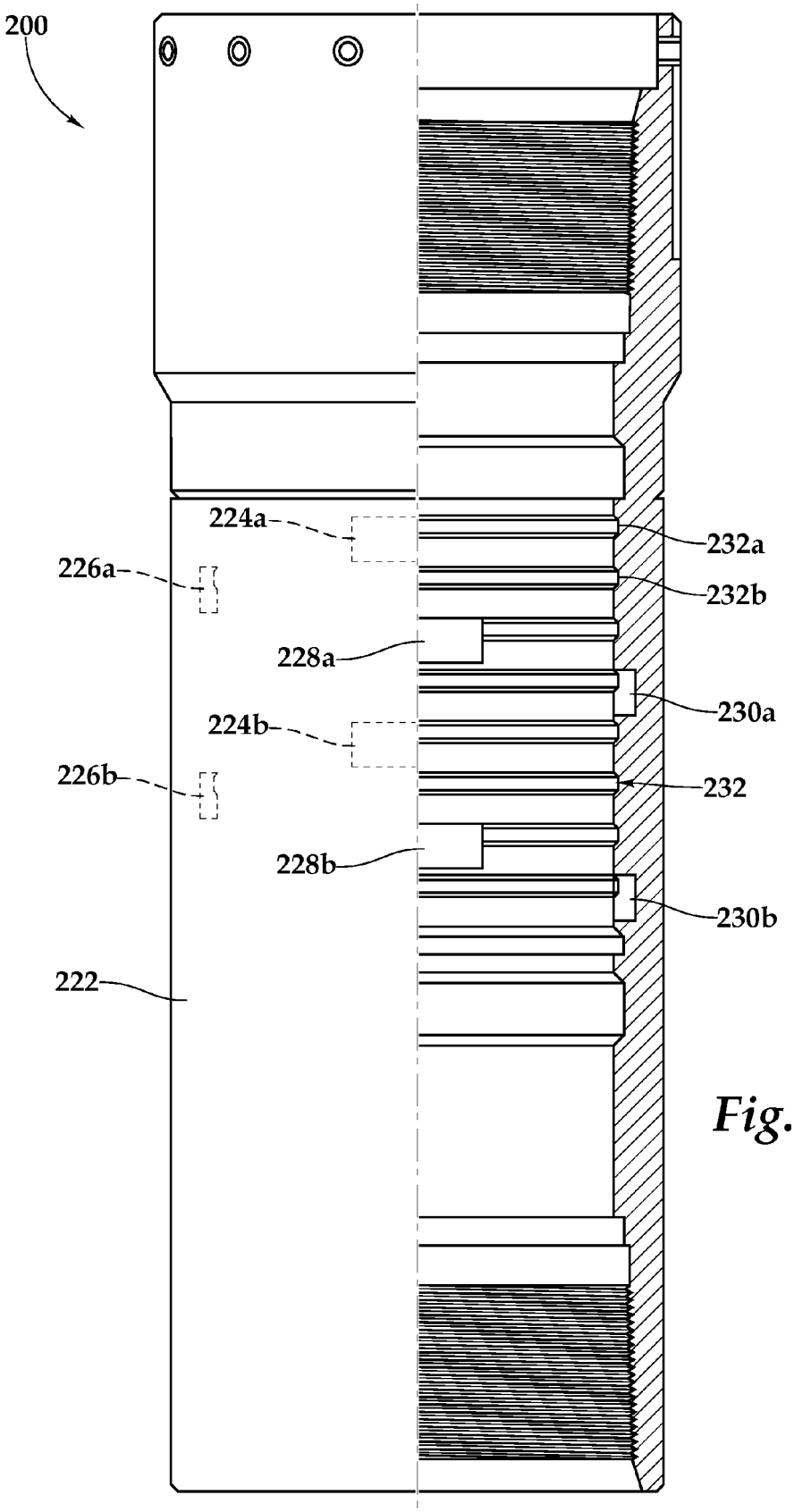
FIG. 5 is a quarter sectional view of a latch coupling operable for use with a galvanically isolated exit joint for a multilateral well according to an embodiment of the present invention.

Referring next to FIG. 5, a latch coupling of the present invention is depicted and generally designated 200. Latch coupling 200 has a generally tubular body 222 and may be coupled to other tools or tubulars of casing string 34. Latch coupling 200 has a plurality of preferential circumferential alignment elements depicted as a plurality of recesses disposed within the inner surface of latch coupling 200. In the illustrated embodiment, there are four sets of two recesses that are disposed in different axial and circumferential positions or locations within the inner surface of latch coupling 200. For example, a first set of two slots or recesses 224*a*, 224*b* (collectively recesses 224) are disposed within the inner surface of latch coupling 200 at substantially the same circumferential positions and different axial positions. A second set of two slots or recesses 226*a*, 226*b* (collectively recesses 226) are disposed within the inner surface of latch coupling 200 at substantially the same circumferential positions and different axial positions. A third set of two slots or recesses 228*a*, 228*b* (collectively recesses 228) are disposed within the inner surface of latch coupling 200 at substantially the same circumferential positions and different axial positions. A fourth set of two slots or recesses 230*a*, 230*b* (collectively recesses 230) are disposed within the inner surface of latch coupling 200 at substantially the same circumferential positions and different axial positions. As shown, recesses 226 are disposed within the inner surface of latch coupling 200 at a ninety degree angle circumferentially from recesses 224. Likewise, recesses 228 are disposed within the inner surface of latch coupling 200 at a ninety degree angle circumferentially from recesses 226. Finally, recesses 230 are disposed within the inner surface of latch coupling 200 at a ninety degree angle circumferentially from recesses 228. Preferably, recesses 224, 226, 228, 230 only partially extend circumferentially about the internal surface of latch coupling 220.

Additionally, latch coupling 200 includes an internal profile depicted as a plurality of recessed grooves 232 such as recessed grooves 232*a*, 232*b* that extend circumferentially around the inner surface of latch coupling 200. The result is a specially contoured area where the internal profile and preferential circumferential alignment elements of latch coupling 200 are operable to cooperate with an external key profile and anchor buttons associated with the latch assembly of the whipstock assembly to axially and circumferentially anchor and orient the whipstock assembly in a particular desired circumferential orientation relative to latch coupling 200.

Figure 6:
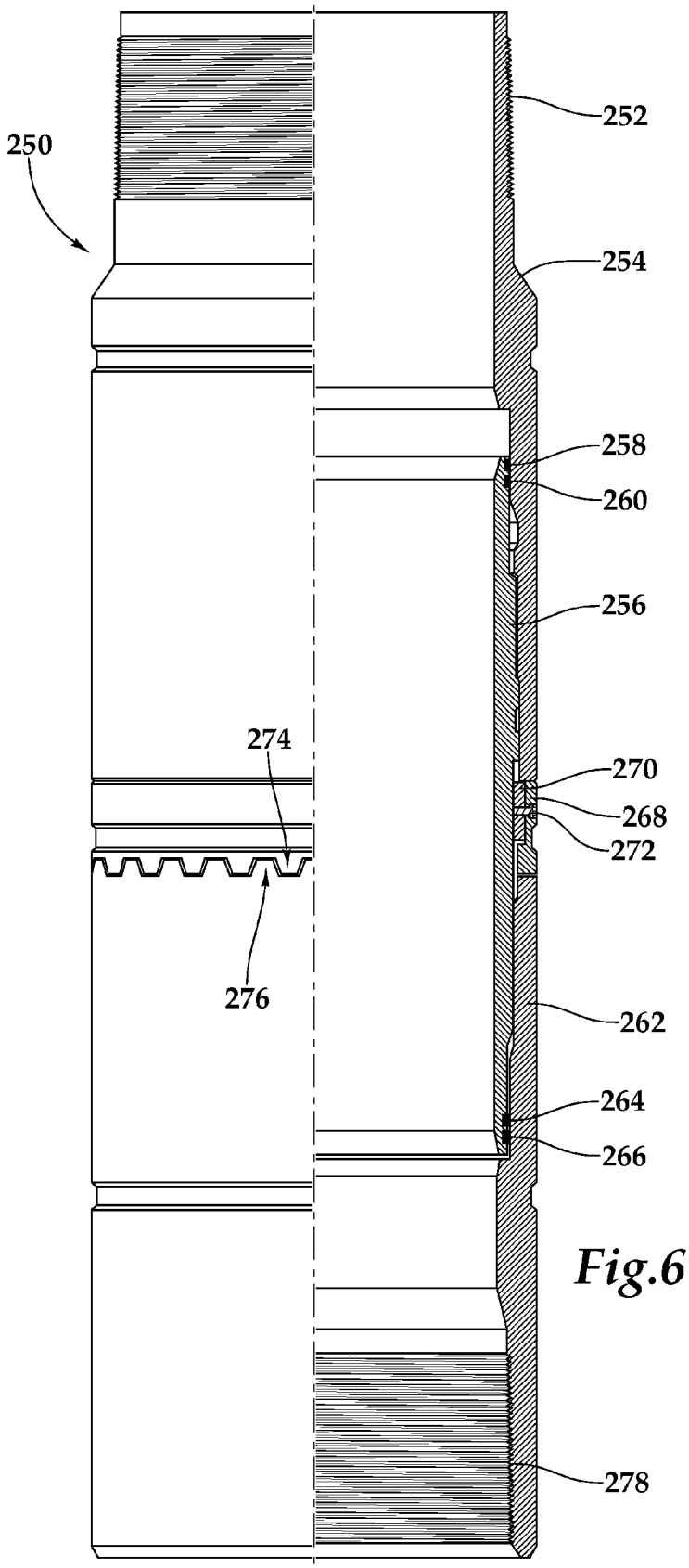
FIG. 6 is a quarter sectional view of a casing alignment sub operable for use with a galvanically isolated exit joint for a multilateral well according to an embodiment of the present invention.

With reference now to FIG. 6, a casing alignment sub of the present invention is depicted and generally designated 250. Casing alignment sub 250 includes an upper threaded connector 252 and a lower threaded connector 278 for connecting casing alignment sub to other tools or tubulars in casing string 34 such as between latch coupling 102 and alignment bushing 104 as described above. Casing alignment sub 250 provides angular alignment of alignment bushing 104 with respect to latch coupling 102 for the purposes of aligning a particular set of recesses 224, 226, 228, 230 with an alignment slot on alignment bushing 104, as discussed further below.

Casing alignment sub 250 includes an upper connector sub 254 that is partially positioned about a mandrel 256 and sealingly engaged therewith via seals 258, 260. Casing alignment sub 250 also includes a lower connector sub 262 that is partially positioned about mandrel 256 and sealingly engaged therewith via seals 264, 266. Casing alignment sub 250 further includes an adjustment ring 268 that is disposed about mandrel 256 and coupled thereto via key assembly 270 and set screw 272. Adjustment ring 268 includes a plurality of teeth, splines or dogs 274 that mate with similar teeth, splines or dogs 276 of lower connector sub 262. Adjustment ring 268 may be rotationally adjusted to provide a desired circumferential or angular position of upper connector sub 254 relative to lower connector sub 262.

In one embodiment, adjustment ring 268 may provide plus/minus one degrees of rotational adjustment between upper connector sub 254 and lower connector sub 262. When casing alignment sub 250 is positioned between alignment bushing 104 and latch coupling 102, a longitudinal slot of alignment bushing 104 may be circumferentially aligned with certain of the preferential circumferential alignment elements of latch coupling 102, thereby circumferentially referencing the longitudinal slot with the desired preferential circumferential alignment element. This circumferential alignment can thus be achieved by making a rotational adjustment between upper connector sub 254 and lower connector sub 262.

Figure 7:
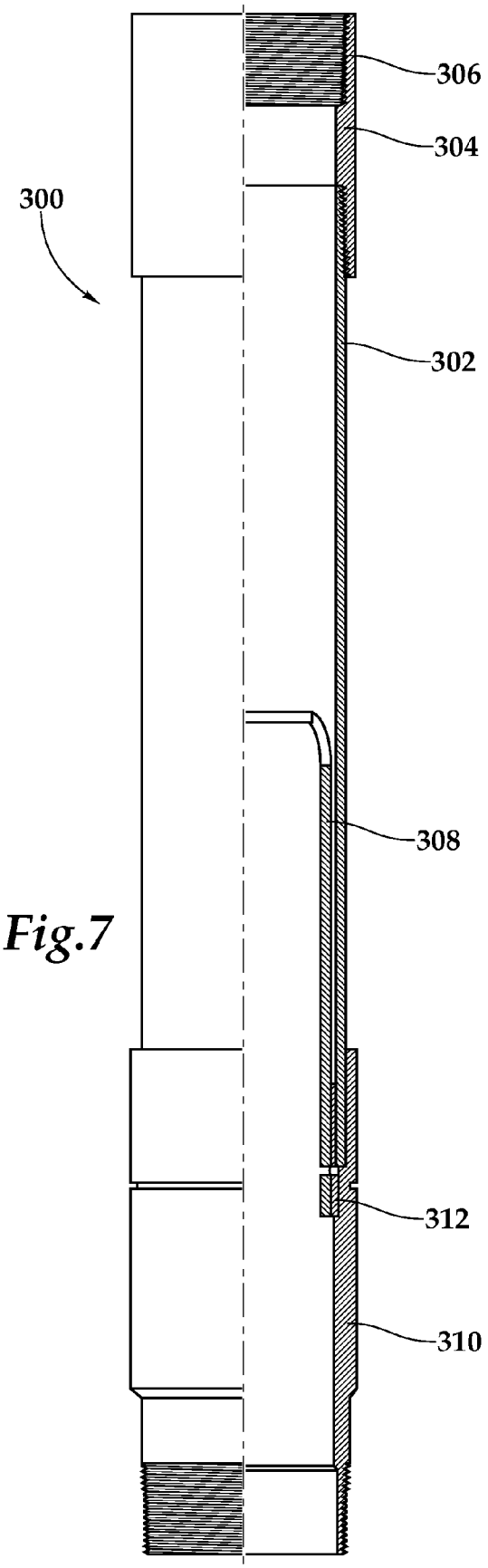
FIG. 7 is a quarter sectional view of an alignment bushing operable for use with a galvanically isolated exit joint for a multilateral well according to an embodiment of the present invention.
Figure 8:
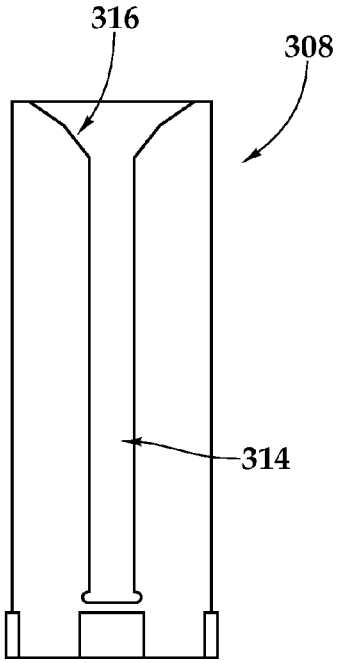
FIG. 8 is a side view of a sleeve of an alignment bushing operable for use with a galvanically isolated exit joint for a multilateral well according to an embodiment of the present invention.

Referring now to FIG. 7, an alignment bushing of the present invention is depicted and generally designated 300. Alignment bushing 300 is formed from a generally tubular member 302 that is illustrated with an upper collar 304 having a thread connector 306 for coupling with other tools or tubulars in casing string 34. Positioned within tubular member 302 is a generally tubular sleeve 308. Sleeve 308 is supported within tubular member 302 by lower coupling 310 via lugs 312. Preferably, sleeve 308 is formed from a material that is easily drillable therethrough, such as aluminum. As best seen in FIG. 8, sleeve 308 includes a longitudinal slot 314 for accepting or engaging a key or other alignment element on survey tool 110 or whipstock assembly 114. Preferably, longitudinal slot 314 has a beveled entrance 316 for easier access. In addition, the top of sleeve 308 has a flat surface for depth confirmation and tag of survey tool 110. In operation, survey tool 110 engages with longitudinal slot 314 such that the offset angle between the circumferential location of longitudinal slot 314 and the desired circumferential location of the window to be formed in the exit joint of casing string 34 can be determined. In certain installation, the desired orientation of the lateral wellbore and thus the window may be opposite to that of the direction of gravity. Thus, survey tool 110 may provide a determination of the orientation of longitudinal slot 314 relative to the direction of gravity which can then be correlated to the desired orientation of the window.

Figure 9A:
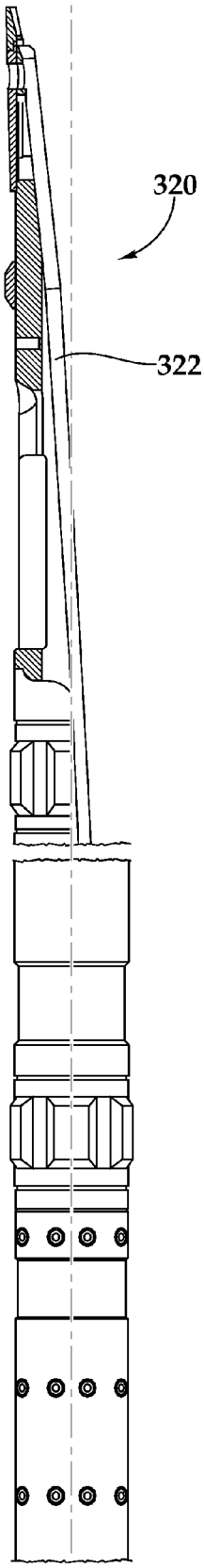
FIGS. 9A-9B are side views of a whipstock assembly operable for use with a galvanically isolated exit joint for a multilateral well according to an embodiment of the present invention.
Figure 9B:
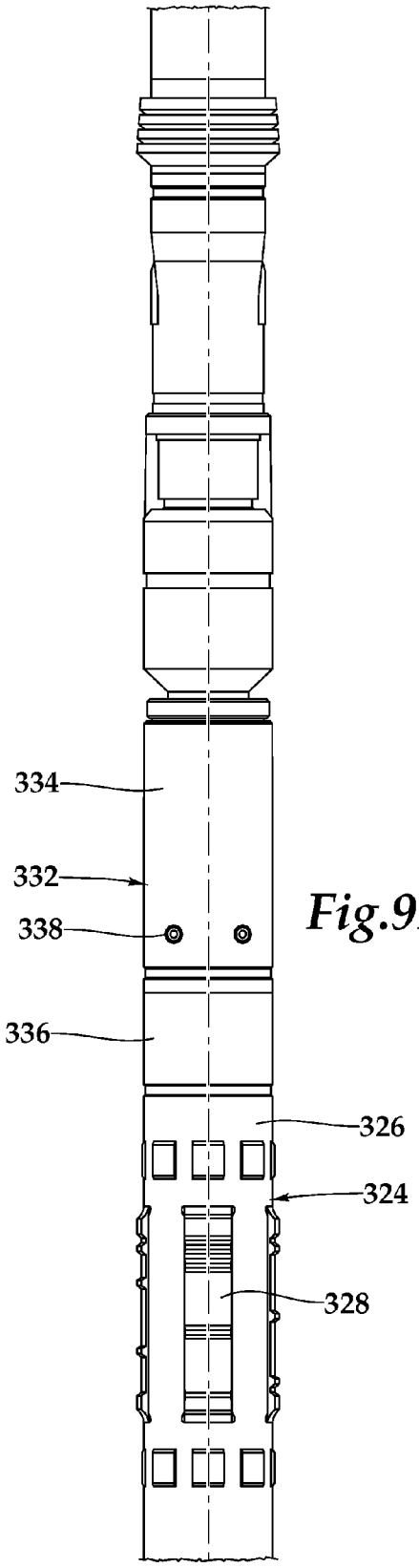

Referring next to FIGS. 9A-9B, a whipstock assembly of the present invention is depicted and generally designated 320. Whipstock assembly 320 includes a whipstock face 322 disposed substantially at the upper end of whipstock assembly 320. Whipstock face 322 is tapered from its upper end to its lower end to provide a deflector surface operable to direct a milling or drilling assembly to form a window in the desired circumferential orientation in the window joint of the casing string.

In the illustrated embodiment, whipstock assembly 320 includes a latch assembly 324. Latch assembly 324 includes a latch housing 326 with a plurality of windows through which spring operated keys 328 extend. Keys 328 are configured to cooperate with the internal profile and preferential circumferential alignment elements of a latch coupling, as described above, such that whipstock assembly 320 is operable to be located and circumferentially fixed within the latch coupling.

In the illustrated embodiment, whipstock assembly 320 also includes a swivel subassembly 332. Swivel subassembly 332 include an upper swivel housing 334 and a lower swivel housing 336 that are rotatable relative to one another and are operable to be rotationally locked relative to one another via set screws 338 or other locking device. In one embodiment swivel subassembly 332 may provide plus/minus one degrees of rotational adjustment between upper swivel housing 334 and lower swivel housing 336 such that a desired circumferential or angular position may be established between whipstock face 322 and a particular set of anchor buttons 330.

Figure 10A:
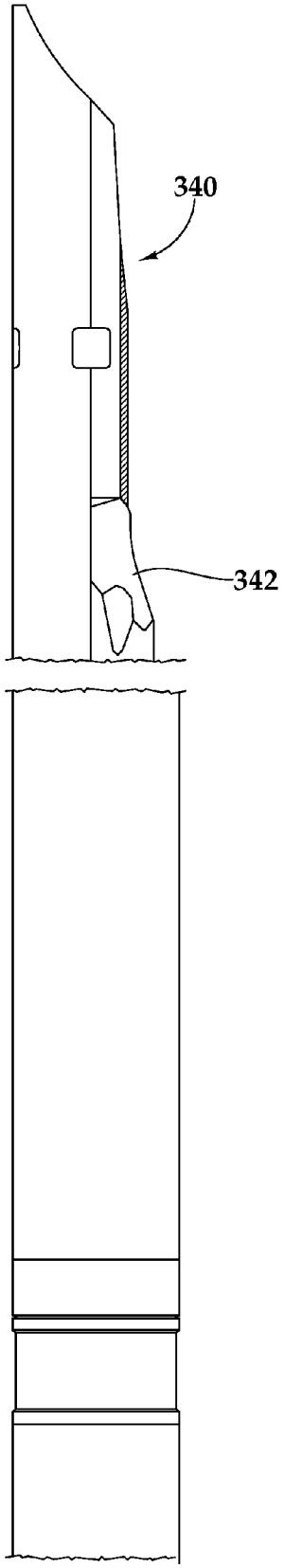
FIGS. 10A-10B are side views of a deflector tool operable for use with a galvanically isolated exit joint for a multilateral well according to another embodiment of the present invention.
Figure 10B:
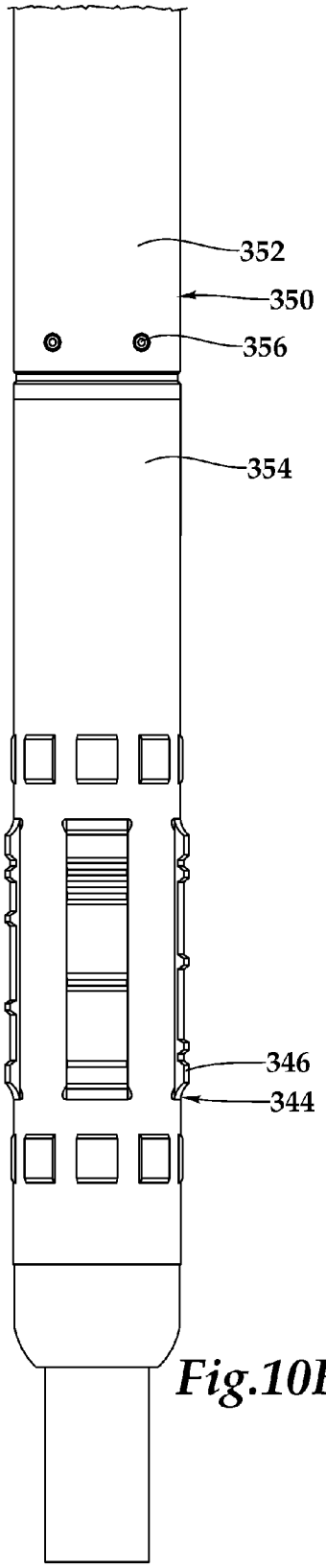

Referring next to FIGS. 10A-10B, a deflector tool of the present invention is depicted and generally designated 340. Deflector tool 340 includes a deflector face 342 for providing a deflector surface operable to direct completion equipment through the window formed in the window joint of the casing string. In the illustrated embodiment, deflector tool 340 includes a latch assembly 344 having spring operated keys 346 that are configured to cooperate with the internal profile and preferential circumferential alignment elements of a latch coupling. Deflector tool 340 also includes a swivel subassembly 350 having an upper swivel housing 352 and a lower swivel housing 354 that are rotatable relative to one another and are operable to be rotationally locked relative to one another via set screws 356 or other locking device.

In operation, a casing string having a galvanically isolated exit joint interconnected therein and an alignment subassembly preferably including an alignment bushing, a casing alignment sub and a latch coupling is run in the wellbore. Preferably, the longitudinal slot or other circumferential indicator of the alignment bushing is referenced to a particular set of preferential circumferential alignment elements of the latch coupling prior to run in. Alternatively, in embodiments where the alignment subassembly is not interconnected with the casing string, an alignment subassembly may now be run in the installed casing string and positioned relative to the exit joint.

When it is desired to open the window in the exit joint, a survey tool may be run in the casing string to the alignment subassembly and preferably to the alignment bushing to determine an offset angle formed between a circumferential reference element, preferably the longitudinal slot of the alignment bushing, and a desired circumferential orientation of the window. Once the offset angle is identified, the alignment bushing may be drilled out such that the remainder of the main wellbore may be drilled and completed. Thereafter, the whipstock assembly is configured by operating the swivel assembly to rotate the deflector surface relative to a latch assembly to counteract the offset angle. The whipstock assembly is now run in the casing string until the keys of the latch assembly engage with the profile of the alignment subassembly. The whipstock assembly may then be rotated until the keys of the latch assembly engage with the preferential circumferential alignment elements of the latch coupling. This operation orients the deflector surface of the whipstock assembly in a desired circumferential orientation relative to the exit joint. Thereafter, the window can be milled or drilled through the exit joint in the desired circumferential direction. Once the window is open, the lateral wellbore can be drilled through the opening. When drilling of the lateral wellbore in complete, the whipstock assembly may be retrieved to the surface and a deflector tool, which has been configured by operating the swivel assembly to rotate the deflector surface relative to the latch assembly to counteract the offset angle, may be installed within the alignment subassembly. In this manner, the deflector surface of the deflector tool will deflect the completion string and associated tubing string into the lateral wellbore until the lateral junction stabs into and seals within the deflector tool.

Figures 11A, 11B, 11C:
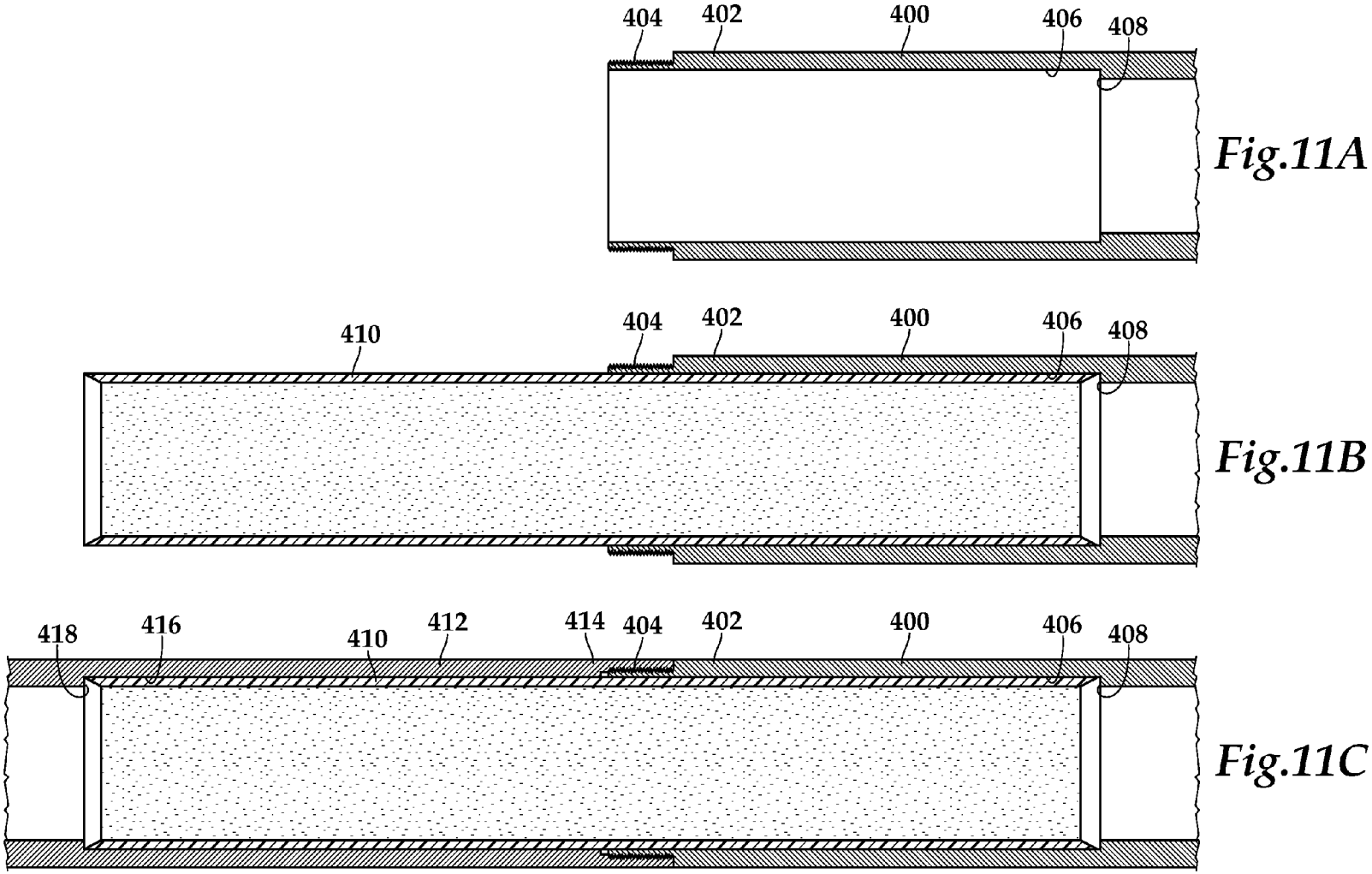
FIGS. 11A-11C are cross sectional views depicting a process for assembling a galvanically isolated exit joint for a multilateral well according to an embodiment of the present invention.

Referring next to FIGS. 11A-11C, an assembly process associated with interconnecting an exit joint within a casing string is depicted. Exit joint 400 is formed from a material, such as aluminum, that is easy to mill or drill through such that a window for a lateral well can be formed therethrough. In the illustrated portion, exit joint 400 has an pin end 402 that is operable to be threadably interconnected with a mating box end of another casing joint. Pin end 402 has a nonconductive layer 404 positioned therearound. Nonconductive layer 404 may be applied to pin end 402 by spraying, painting, dipping or the like or may be attached to pin end 402 by threading if nonconductive layer 404 is formed prior to attachment. Preferably, nonconductive layer 404 is formed from a nonconductive material such as a polymer. As best seen in FIG. 11A, exit joint 400 includes a radially reduced section 406 and a shoulder 408.

Positioned within radially reduced section 406 of exit joint 400 is a nonconductive sleeve 410, as best seen in FIG. 11B. Sleeve 410 is preferably formed from a nonconductive material such as a polymer including PEEK polymers and plastics, a fiberglass such as S-glass fiberglass with a nonconductive matrix or the like. In addition, sleeve 410 may include a material to increase wear resistance so that contact with drill pipe or other operations within the casing string will not result in wear through sleeve 410. For example, tungsten or ceramic beads could be applied on or embedded within sleeve 410. Sleeve 410 may include a single layer of base material with the wear resistance material at or near the inner surface thereof. Alternatively, sleeve 410 may be formed from multiple layers of base material with the wear resistance material embedded between layers. Preferably, sleeve 410 has tapered ends to minimize the risk of damage to sleeve 410 during wellbore operations. Alternatively or additionally, a wear cone or other protective ring could be applied over the leading edges of sleeve 410 to provide protection. As illustrated, sleeve 410 is fully formed then installed within exit joint 410.

Thereafter, a standard casing joint 412 having a box end 414 may be installed over the exposed end of sleeve 410. As best seen in FIG. 11C, casing joint 412 is threadably coupled to pin end 402 of exit joint 400. Casing joint 412 is typically formed from steel such as low alloy steel. Casing joint 412 includes a radially reduced section 416 and a shoulder 418. As illustrated, sleeve 410 is received within reduced section 416 of casing joint 412. To prevent any fluid infiltration between sleeve 410 and the interior of exit joint 400 and casing joint 412, a fluid barrier is preferably provided therebetween. For example, prior to installation, an epoxy sealant or glue may be applied to the outer surface of sleeve 410 or to the inner surface of radially reduced section 406 of exit joint 400, the inner surface of radially reduced section 416 of casing joint 412 or both. Alternatively or additionally, o-rings or similar packing elements may be installed in a groove formed at each end of sleeve 410 or in grooves formed respectively in exit joint 400 and casing joint 412 (not pictured).

Use of sleeve 410, either alone or in conjunction with nonconductive layer 404, reduces or prevents galvanic corrosion, including hydrogen embrittlement of casing joint 412. This is achieved by eliminating the metal-to-metal contact between the aluminum and the steel when, for example, a completion fluid such as a brine fluid or a halide fluid including chloride fluids and bromide fluids, is pumped through a casing string including exit joint 400. In this manner, sleeve 410 provides galvanic isolation between exit joint 400 and casing joint 412 by reducing or preventing the flow of a galvanic current between exit joint 400 and casing joint 412.

Even though a particular process for installing a nonconductive sleeve within exit joint 400 and casing joint 412 has been described, those skilled in the art will understand that other processes may be used to form a casing string having a galvanically isolated aluminum exit joint. For example, a nonconductive sleeve may be formed on the interior of a casing section after exit joint 400 and casing joint 412 are threadably coupled using a deposition process such as a coating process, spraying process or the like.

Figure 12:
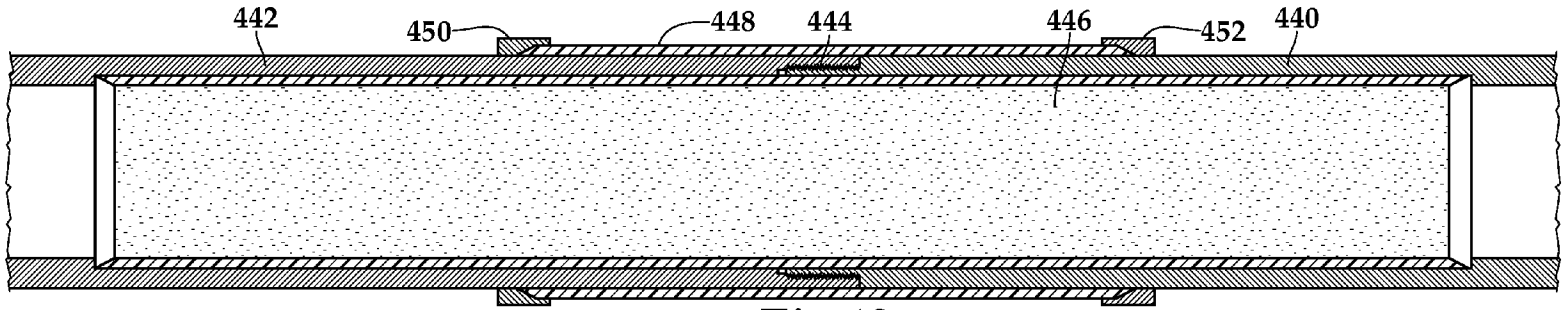
FIG. 12 is a cross sectional view of a galvanically isolated exit joint for a multilateral well according to an embodiment of the present invention.

Referring next to FIG. 12, one interconnection of an exit joint within a casing string is depicted. In the illustrated embodiment, an aluminum exit joint 440 is threadably interconnected with a standard steel casing joint 442. In addition to having a nonconductive layer 444 positioned between the threaded connection and having a nonconductive sleeve 446 positioned within exit joint 440 and casing joint 442 as described above, a nonconductive sleeve 448 is positioned around the interconnection of exit joint 440 and casing joint 442. Sleeve 448 is preferably formed from a single layer or multiple layers of a nonconductive material such as a polymer including PEEK polymers and plastics, a fiberglass such as S-glass fiberglass with a nonconductive matrix or the like. In addition, sleeve 448 may include a material to increase wear resistance, such as tungsten or ceramic beads, so that contact with the wellbore surface during installation does not wear through sleeve 448. Preferably, sleeve 448 has tapered ends to minimize the risk of damage to sleeve 448 during installation. Alternatively or additionally, as illustrated, wear cones 450, 452 or other protective rings could be applied over the leading edges of sleeve 448 to provide protection.

To prevent any fluid infiltration between sleeve 448 and the exterior of exit joint 440 and casing joint 442, a fluid barrier is preferably provided therebetween. For example, an epoxy sealant or glue may be used. Alternatively or additionally, o-rings or similar packing elements may be installed in a groove formed at each end of sleeve 448 or in grooves formed respectively in exit joint 440 and casing joint 442. As described above, sleeve 448 may be formed and then attached to exit joint 440 and casing joint 442. Alternatively, sleeve 448 may be formed directly on the exterior of exit joint 440 and casing joint 442 using a deposition process such as a coating process, a spraying process or the like or using a wrapping process such as wrapping on heat-shrinkable reinforced fiberglass over an epoxy layer then applying heat thereto.

Use of sleeve 448, either alone or in conjunction with nonconductive layer 444, reduces or prevents galvanic corrosion, including hydrogen embrittlement of joint 442. This is achieved by eliminating the metal-to-metal contact between the aluminum and the steel when, for example, an electrolytic fluid surrounds a casing string. In this manner, sleeve 448 provides galvanic isolation between exit joint 440 and casing joint 442 by reducing or preventing the flow of a galvanic current between exit joint 440 and casing joint 442.

Figure 13:
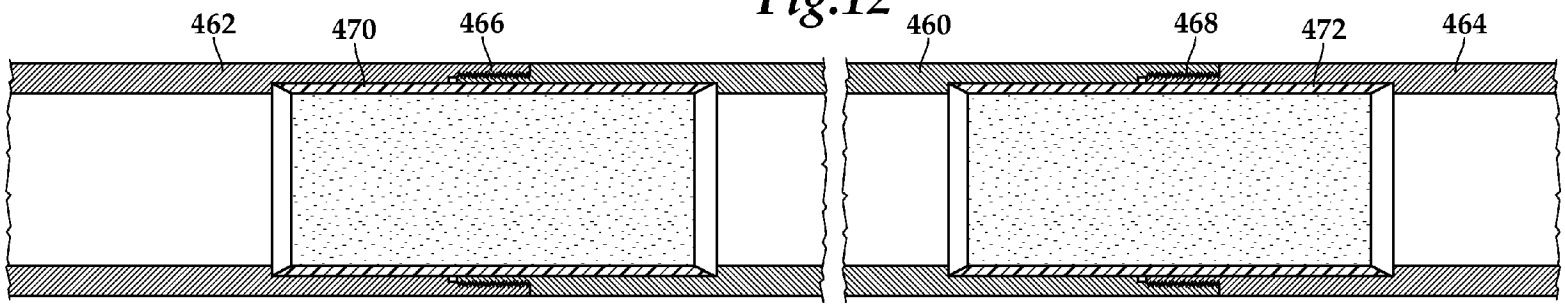
FIG. 13 is a cross sectional view of a galvanically isolated exit joint for a multilateral well according to an embodiment of the present invention.

Referring next to FIG. 13, a galvanically isolated exit joint positioned within a casing string is depicted. In the illustrated embodiment, an aluminum exit joint 460 is threadably interconnected within a casing string between two standard steel casing joints 462, 464. A nonconductive layer 466 may be disposed between the threaded connection coupling exit joint 460 with casing joint 462. Likewise, a nonconductive layer 468 may be disposed between the threaded connection coupling exit joint 460 with casing joint 464. In the illustrated embodiment, a nonconductive sleeve 470 is positioned within the interconnection between exit joint 460 and casing joint 462. Likewise, a nonconductive sleeve 472 is positioned within the interconnection between exit joint 460 and casing joint 464. Sleeves 470, 472 are preferably formed from a single layer or multiple layers of a nonconductive material such as a polymer including PEEK polymers and plastics, a fiberglass such as S-glass fiberglass with a nonconductive matrix or the like. In addition, sleeves 470, 472 may include a material to increase wear resistance. Preferably, sleeves 470, 472 have tapered ends and may additionally have wear cones or other protective rings applied over the leading edges thereof. To prevent any fluid infiltration behind sleeves 470, 472, a fluid barrier, such as epoxy sealant, glue or o-rings, is preferably provided therebetween.

Use of sleeves 470, 472, either alone or in conjunction with nonconductive layers 466, 468, reduces or prevents galvanic corrosion, including hydrogen embrittlement of casing joints 462, 464. This is achieved by eliminating the metal-to-metal contact between the aluminum and the steel when, for example, the casing string is in an electrolytic fluid environment. In this manner, sleeves 470, 472 provides galvanic isolation between exit joint 460 and casing joints 462, 464 by preventing the flow of a galvanic current between exit joint 460 and casing joints 462, 464.

Figure 14:
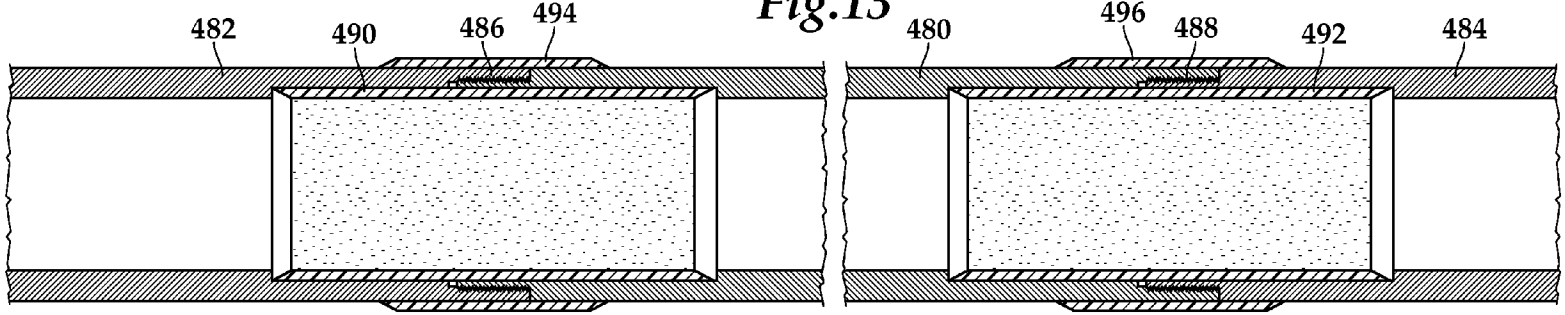
FIG. 14 is a cross sectional view of a galvanically isolated exit joint for a multilateral well according to an embodiment of the present invention.

Referring next to FIG. 14, a galvanically isolated exit joint positioned within a casing string is depicted. In the illustrated embodiment, an aluminum exit joint 480 is threadably interconnected within a casing string between two standard steel casing joints 482, 484. A nonconductive layer 486 may be disposed between the threaded connection coupling exit joint 480 with casing joint 482. Likewise, a nonconductive layer 488 may be disposed between the threaded connection coupling exit joint 480 with casing joint 484. In the illustrated embodiment, a nonconductive sleeve 490 is positioned within the interconnection of exit joint 480 and casing joint 482. Likewise, a nonconductive sleeve 492 is positioned within the interconnection of exit joint 480 and casing joint 484. A nonconductive sleeve 494 is positioned around the threaded coupling between exit joint 480 and casing joint 482. Likewise, a nonconductive sleeve 496 is positioned around the threaded coupling between exit joint 480 and casing joint 484. Sleeves 490, 492, 494, 496 are preferably formed from a single layer or multiple layers of a nonconductive material such as a polymer, a fiberglass or the like. In addition, sleeves 490, 492, 494, 496 may include a material to increase wear resistance. Preferably, sleeves 490, 492, 494, 496 have tapered ends and may additionally have wear cones or other protective rings applied over the leading edges thereof. To prevent any fluid infiltration behind sleeves 490, 492, 494, 496, a fluid barrier, such as epoxy sealant, glue or o-rings may be used.

Use of sleeves 490, 492, 494, 496, either alone or in conjunction with nonconductive layers 486, 488, reduces or prevents galvanic corrosion, including hydrogen embrittlement of casing joints 482, 484. This is achieved by eliminating the metal-to-metal contact between the aluminum and the steel when, for example, the casing string is in an electrolytic fluid environment. In this manner, sleeves 490, 492, 494, 496 provide galvanic isolation between exit joint 480 and casing joints 482, 484 by preventing the flow of a galvanic current therebetween.

Figure 15:
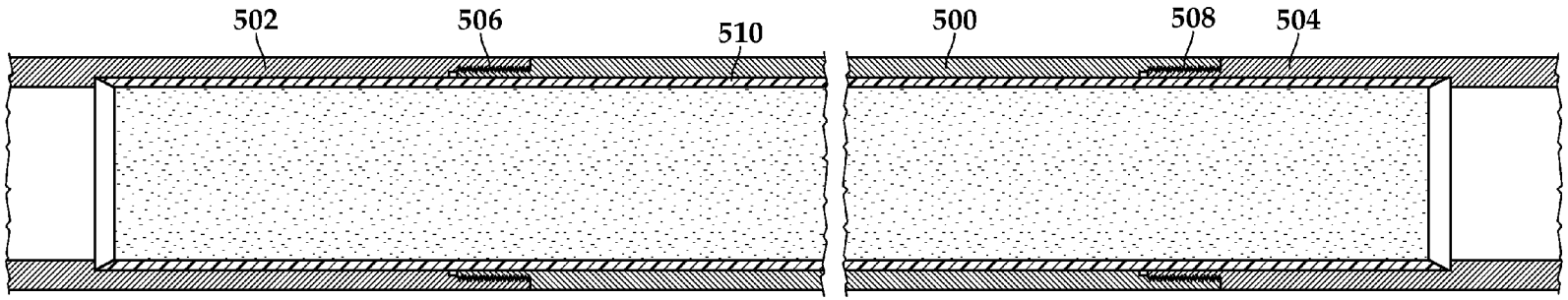
FIG. 15 is a cross sectional view of a galvanically isolated exit joint for a multilateral well according to an embodiment of the present invention.

Referring next to FIG. 15, a galvanically isolated exit joint positioned within a casing string is depicted. In the illustrated embodiment, an aluminum exit joint 500 is threadably interconnected within a casing string between two standard steel casing joints 502, 504. A nonconductive layer 506 may be disposed between the threaded connection coupling exit joint 500 with casing joint 502. Likewise, a nonconductive layer 508 may be disposed between the threaded connection coupling exit joint 500 with casing joint 504. In the illustrated embodiment, a nonconductive sleeve 510 is positioned within exit joint 500 and extends into both casing joints 502, 504. Sleeve 510 is preferably formed from a single layer or multiple layers of a nonconductive material such as a polymer including PEEK polymers and plastics, a fiberglass such as S-glass fiberglass with a nonconductive matrix or the like. In addition, sleeve 510 may include a material to increase wear resistance. Preferably, sleeve 510 has tapered ends and may additionally have wear cones or other protective rings applied over the leading edges thereof. To prevent any fluid infiltration behind sleeve 510, a fluid barrier, such as epoxy sealant, glue or o-rings, is preferably provided therebetween.

Use of sleeve 510, either alone or in conjunction with nonconductive layers 506, 508, reduces or prevents galvanic corrosion, including hydrogen embrittlement of casing joints 502, 504. This is achieved by eliminating the metal-to-metal contact between the aluminum and the steel when, for example, the interior of the casing string is in an electrolytic fluid environment. In this manner, sleeve 510 provides galvanic isolation between the interiors of the exit joint 500 and casing joints 502, 504 by preventing the flow of a galvanic current between exit joint 500 and casing joints 502, 504.

Figure 16:
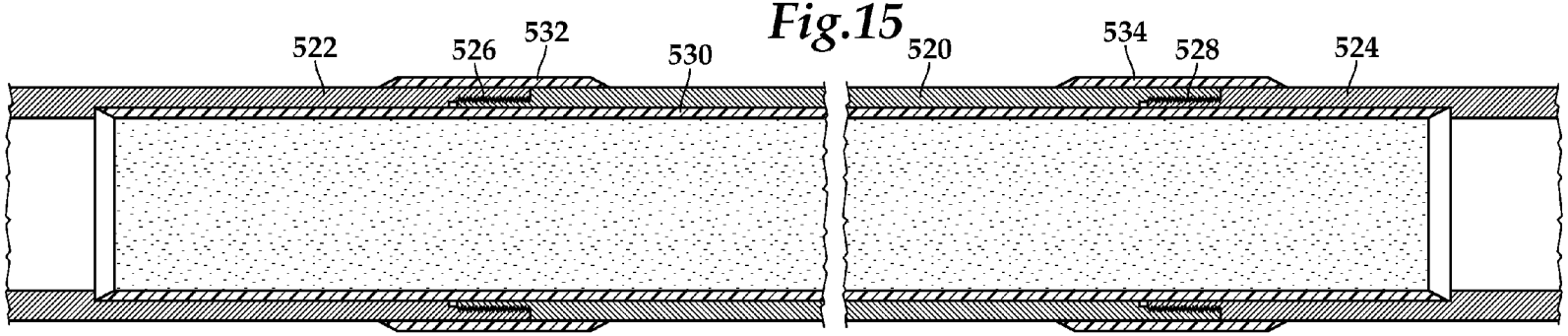
FIG. 16 is a cross sectional view of a galvanically isolated exit joint for a multilateral well according to an embodiment of the present invention.

Referring next to FIG. 16, a galvanically isolated exit joint positioned within a casing string is depicted. In the illustrated embodiment, an aluminum exit joint 520 is threadably interconnected within a casing string between two standard steel casing joints 522, 524. A nonconductive layer 526 may be disposed between the threaded connection coupling exit joint 520 with casing joint 522. Likewise, a nonconductive layer 528 may be disposed between the threaded connection coupling exit joint 520 with casing joint 524. In the illustrated embodiment, a nonconductive sleeve 530 is positioned within exit joint 520 and extends into both casing joints 522, 524. A nonconductive sleeve 532 is positioned around the threaded coupling between exit joint 520 and casing joint 522. Likewise, a nonconductive sleeve 534 is positioned around the threaded coupling between exit joint 520 and casing joint 524. Sleeves 530, 532, 534 are preferably formed from a single layer or multiple layers of a nonconductive material such as a polymer, a fiberglass or the like. In addition, sleeves 530, 532, 534 may include a material to increase wear resistance. Preferably, sleeves 530, 532, 534 have tapered ends and may additionally have wear cones or other protective rings applied over the leading edges thereof. To prevent any fluid infiltration behind sleeves 530, 532, 534, a fluid barrier, such as epoxy sealant, glue or o-rings may be used.

Use of sleeves 530, 532, 534, either alone or in conjunction with nonconductive layers 526, 528, reduces or prevents galvanic corrosion, including hydrogen embrittlement of casing joints 522, 524. This is achieved by eliminating the metal-to-metal contact between the aluminum and the steel when, for example, the casing string is in an electrolytic fluid environment. In this manner, sleeves 530, 532, 534 provide galvanic isolation between exit joint 520 and casing joints 522, 524 by preventing the flow of a galvanic current therebetween.

Figure 17:
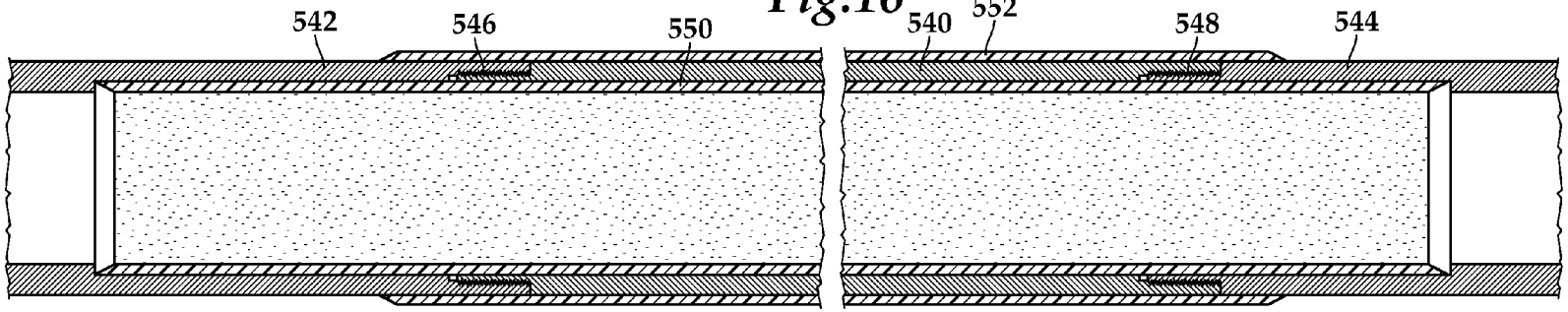
FIG. 17 is a cross sectional view of a galvanically isolated exit joint for a multilateral well according to an embodiment of the present invention.

Referring next to FIG. 17, a galvanically isolated exit joint positioned within a casing string is depicted. In the illustrated embodiment, an aluminum exit joint 540 is threadably interconnected within a casing string between two standard steel casing joints 542, 544. A nonconductive layer 546 may be disposed between the threaded connection coupling exit joint 540 with casing joint 542. Likewise, a nonconductive layer 548 may be disposed between the threaded connection coupling exit joint 540 with casing joint 544. In the illustrated embodiment, a nonconductive sleeve 550 is positioned within exit joint 540 and extending into both casing joints 542, 544. Likewise, a nonconductive sleeve 552 is positioned around exit joint 520 and extends over portions of both casing joints 542, 544. Sleeves 550, 552 are preferably formed from a single layer or multiple layers of a nonconductive material such as a polymer, a fiberglass or the like. In addition, sleeves 550, 552 may include a material to increase wear resistance. Preferably, sleeves 550, 552 have tapered ends and may additionally have wear cones or other protective rings applied over the leading edges thereof. To prevent any fluid infiltration behind sleeves 550, 552, a fluid barrier, such as epoxy sealant, glue or o-rings may be used.

Use of sleeves 550, 552, either alone or in conjunction with nonconductive layers 546, 548, reduces or prevents galvanic corrosion, including hydrogen embrittlement of casing joints 542, 544. This is achieved by eliminating the metal-to-metal contact between the aluminum and the steel when, for example, the casing string is in an electrolytic fluid environment. In this manner, sleeves 550, 552 provide galvanic isolation between exit joint 540 and casing joints 542, 544 by preventing the flow of a galvanic current therebetween.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A casing string having an axial direction, the casing string positionable in a wellbore, the casing string comprising:

first and second steel casing joints threadably interconnectable within the casing string each having a radially reduced section;

an aluminum exit joint positioned between the first and second steel casing joints, the aluminum exit joint having a first threaded interconnection with the first steel casing joint and a second threaded interconnection with the second steel casing joint, the aluminum exit joint operable to have a window formed therethrough;

a first sleeve positioned interiorly within the first threaded interconnection and extending in the axial direction from within the aluminum exit joint into the radially reduced section of the first steel casing joint such that an outer surface of the first sleeve contacts the aluminum exit joint, the first threaded interconnection and the radially reduced section of the first casing joint, thereby providing galvanic isolation between the aluminum exit joint and the first steel casing joint; and a second sleeve positioned interiorly within the second threaded interconnection and extending in the axial direction from within the aluminum exit joint into the radially reduced section of the second steel casing joint such that an outer surface of the second sleeve contacts the aluminum exit joint, the second threaded interconnection and the radially reduced section of the second casing joint, thereby providing galvanic isolation between the aluminum exit joint and the second steel casing joint.

2. The casing string as recited in claim 1 further comprising a first nonconductive layer positioned within the first interconnection preventing metal-to-metal contact between the aluminum exit joint and the first steel casing joint and a second nonconductive layer positioned within the second interconnection preventing metal-to-metal contact between the aluminum exit joint and the second steel casing joint.

3. The casing string as recited in claim 1 wherein the first and second sleeves are formed from a nonconductive material.

4. The casing string as recited in claim 3 wherein the nonconductive material is selected from the group consisting of polymers and fiberglass.

5. The casing string as recited in claim 1 wherein the first and second sleeves further comprise a wear resistant material.

6. The casing string as recited in claim 5 wherein the wear resistant material is selected from the group consisting of tungsten and ceramics.

7. A casing string having an axial direction, the casing string positionable in a wellbore, the casing string comprising:

first and second steel casing joints threadably interconnectable within the casing string each having a radially reduced section;

an aluminum exit joint positioned between the first and second steel casing joints, the aluminum exit joint having a first threaded interconnection with the first steel casing joint and a second threaded interconnection with the second steel casing joint, the aluminum exit joint operable to have a window formed therethrough; and a sleeve positioned interiorly within the aluminum exit joint and extending in the axial direction from within the aluminum exit joint through the first threaded interconnection into the radially reduced section of the first steel casing joint and through the second threaded interconnection into the radially reduced section of the second steel casing joint such that an outer surface of the sleeve contacts the aluminum exit joint, the first and second threaded interconnections and the radially reduced section of the first and second casing joint, thereby providing galvanic isolation between the aluminum exit joint and the first and second steel casing joints.

8. The casing string as recited in claim 7 further comprising a first nonconductive layer positioned within the first interconnection preventing metal-to-metal contact between the aluminum exit joint and the first steel casing joint and a second nonconductive layer positioned within the second interconnection preventing metal-to-metal contact between the aluminum exit joint and the second steel casing joint.

9. The casing string as recited in claim 7 wherein the sleeve is formed from a nonconductive material.

10. The casing string as recited in claim 9 wherein the nonconductive material is selected from the group consisting of polymers and fiberglass.

11. The casing string as recited in claim 7 wherein the sleeve further comprises a wear resistant material.

12. The casing string as recited in claim 11 wherein the wear resistant material is selected from the group consisting of tungsten and ceramics.

* * * * *